US008602808B2

(12) United States Patent
Ashour

(10) Patent No.: US 8,602,808 B2
(45) Date of Patent: Dec. 10, 2013

(54) HOLDER FOR TWO PLUGS

(75) Inventor: Yehya Ashour, Darmstadt (DE)

(73) Assignee: Tyco Electronics Amp GmbH, Bensheim (DE)

( * ) Notice: Subject to any disclaimer, the term of this patent is extended or adjusted under 35 U.S.C. 154(b) by 366 days.

(21) Appl. No.: 12/637,456

(22) Filed: Dec. 14, 2009

(65) Prior Publication Data

US 2010/0088865 A1 Apr. 15, 2010

Related U.S. Application Data

(63) Continuation of application No. PCT/EP2008/057163, filed on Jun. 14, 2008.

(30) Foreign Application Priority Data

Jun. 14, 2007 (DE) ..... 10 2007 027 430

(51) Int. Cl.
*H01R 13/627* (2006.01)

(52) U.S. Cl.
USPC ..... 439/357; 439/374

(58) Field of Classification Search
USPC ..... 439/374, 929
See application file for complete search history.

(56) References Cited

U.S. PATENT DOCUMENTS

| | | | | |
|---|---|---|---|---|
| 3,848,951 | A | 11/1974 | Michaels et al. | |
| 4,046,452 | A | 9/1977 | Cassarly | |
| 4,469,393 | A | 9/1984 | Chewning, Jr. et al. | |
| 5,727,969 | A | 3/1998 | Yamanashi | |
| 5,899,768 | A * | 5/1999 | Kameyama | 439/374 |
| 5,975,935 | A * | 11/1999 | Yamaguchi et al. | 439/374 |
| 6,332,800 | B2 * | 12/2001 | Kodama | 439/357 |
| 6,378,429 | B1 | 4/2002 | Tomita et al. | |
| 6,709,298 | B2 * | 3/2004 | Bradley | 439/701 |
| 7,264,510 | B2 * | 9/2007 | Koenig et al. | 439/620.14 |
| 7,267,570 | B2 * | 9/2007 | Fry et al. | 439/357 |
| 7,347,714 | B2 * | 3/2008 | Liang | 439/374 |
| 7,594,823 | B2 * | 9/2009 | Moscovitch | 439/374 |
| 7,742,289 | B2 * | 6/2010 | Quijano et al. | 361/679.21 |

FOREIGN PATENT DOCUMENTS

GB 2295731 A 6/1996

OTHER PUBLICATIONS

International Search Report for PCT/EP2008/057163 dated Jul. 31, 2008, 2 pages.

* cited by examiner

*Primary Examiner* — Hien Vu
(74) *Attorney, Agent, or Firm* — Barley Snyder

(57) ABSTRACT

A simple and secure holder for securing and releasing a first and second plug without requiring additional components. The holder includes a slide and a projecting, rigid securing member on the first plug. The rigid securing member is positioned at a distance away from the slide. The holder includes a slide receptacle and a resilient lock on the second plug, with the resilient lock being positioned at a distance away from the slide receptacle. The slide receptacle is configured in such a way that the slide is encompassed by the slide receptacle. A releasable connection is provided between the first plug and the second plug when the slide receptacle receives the slide and the rigid securing member engages the resilient lock locking into a final position. The holder is intended for use, for example, with plugs used in the vehicular industry.

22 Claims, 5 Drawing Sheets

HOLDER FOR TWO PLUGS

CROSS-REFERENCE TO RELATED APPLICATIONS

This application is a continuation of PCT International Application No. PCT/EP2008/057163, filed Jun. 14, 2008, which claims priority under 35 U.S.C. §119 to German Patent Application No. DE 10 2007 027 430.2, filed Jun. 14, 2007.

FIELD OF THE INVENTION

The invention relates to electrical connectors and more particularly to a holder for two plugs.

BACKGROUND

Plug-on-plug holders or fastening members are generally used to provide a simple connection between two plugs, both securely and releasable. These known plug-on-plug holders or fastening members are required, in particular, in the vehicle industry. Additional components such as locking latches or the like are often used for this purpose. However, many of the known plug-on-plug holders or fastening members require additional parts which lead to a more complicated design and expensive manufacturing.

SUMMARY

An object of the invention, among others, is to provide a holder for two plugs that is simple and cost-effective, while being able to be secure and releasable without requiring additional components.

The holder includes first and second plug. A slide and a securing member are formed on the first plug, the securing member is positioned at a distance away from the slide. A slide receptacle is formed on the second plug and configured to unite with the slide upon connection, while a resilient lock, formed on the second plug at a distance away from the side receptacle, is configured to encompass the securing member. A releasable connection is provided between the first plug and the second plug when the slide receptacle receives the slide and the rigid securing member engages the resilient lock, which locks into a final position.

BRIEF DESCRIPTION OF THE DRAWINGS

Embodiments of the invention are described in greater detail in the following description and are shown in a simplified manner in the drawings, of which.

DETAILED DESCRIPTION OF THE EMBODIMENT(S)

For an improved understanding of the invention, it will now be described in more detail with the aid of the embodiments shown in the following figures.

Figure 1:
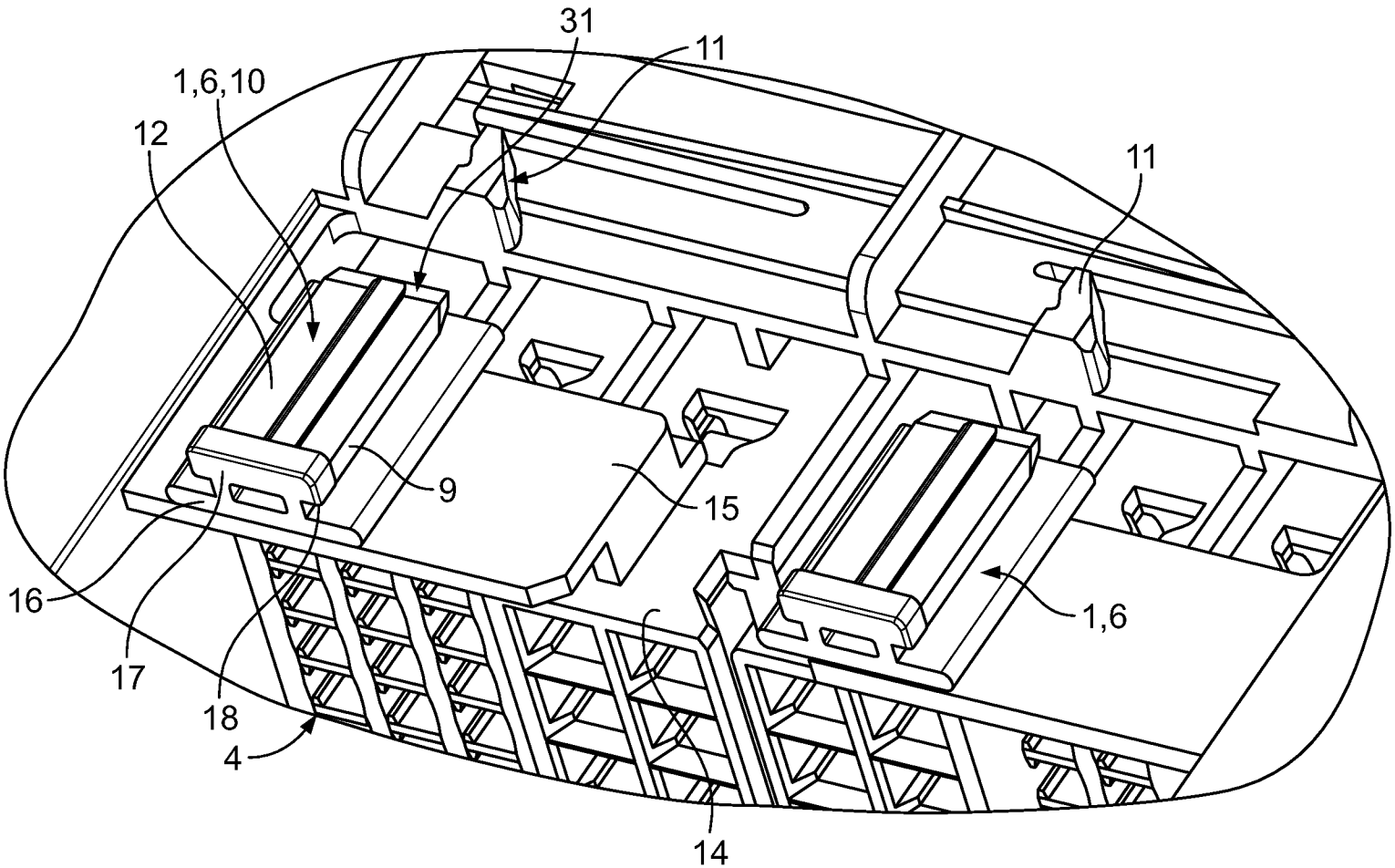
FIG. 1 is a perspective view of a first plug having a first portion of a holder according to the invention.
Figure 2:
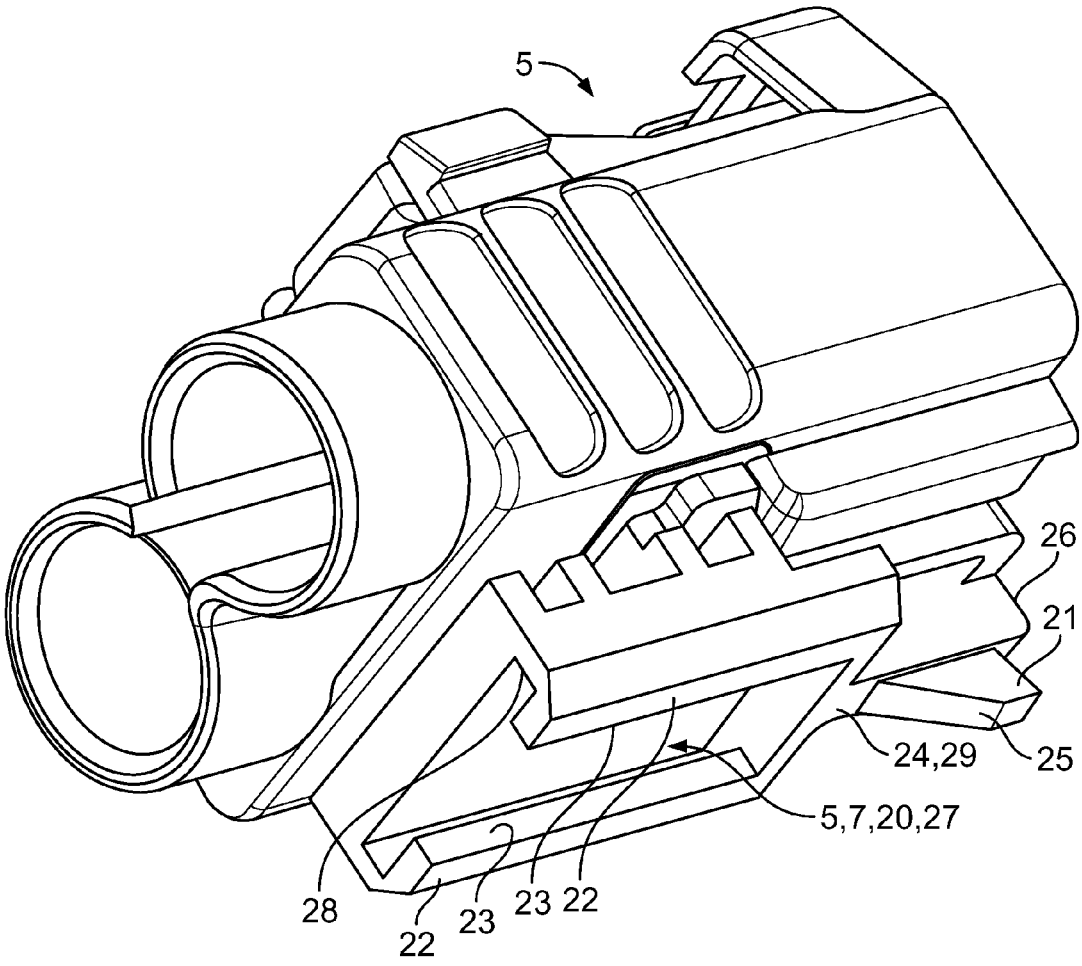
FIG. 2 is a perspective view of a second plug having a second portion of the holder for connection with the first plug.

With reference to FIG. 1, a first plug 4 includes a holder 1 according to the invention for connection to a second plug 5, which is shown in FIG. 2. The holder 1 is divided into a first portion 6 on the first plug 4 and a second portion 7 on the second plug 5 (see FIG. 2).

The first plug 4 is, for example, a 102-pin plug, in the embodiment shown. However, other known plugs could use the holder 1, according to the invention. In the embodiment shown, the second plug 5 is a two-pin plug. As shown in FIG. 1, a plurality of the holders 1, for example two of the holders 1 for two of the second plugs 5, can also be formed on the first plug 4.

The first and second plugs 4, 5 or plug connectors are constructed in the manner conventional in the motor vehicle industry and preferably include a male element, which engages with a corresponding socket or female member to produce an electrical connection. In principle, however, the term plug is not restricted to the male element. It is also possible that the first and second plugs 4, 5 are correspondingly configured plug sockets (with a female member).

The first portion 6 of the holder 1 on the first plug 4 includes two major components, more specifically a slide 10 and a substantially rigid component, which will be referred to as a securing member 11. The securing member 11 should be formed so as to be as rigid as possible, in such a way that slight resilience or yielding is permitted within very narrow limits.

In the embodiment shown, the first plug 4 includes a housing 14 having a base 15, which supports a foot 16 of the slide 10. In the embodiment shown, the base 15 has an angular plateau-like configuration.

The foot 16 of the slide 10 transitions into a tongue 17 in a stepped manner, an inner groove 18 being recessed between the foot 16 and the tongue 17. The tongue 17 is delimited by two side faces, which form the slide faces 9 of the slide 10. At an end face 35 (see FIG. 7), which faces the securing member 11, the tongue 17 is formed so as to be slightly beveled with an arrow-shaped tongue bevel 31. The securing member 11, which is formed having a substantially triangular base, and so as to project prismatically. The securing member 11 is located at a distance away from the slide 10. The securing member 11 rises from a level of a base 15 up to, for example, a level of the tongue 17, or at least up to a level of the foot 16.

FIG. 2 shows the second plug 5 having a second portion 7 of the holder 1, according to the invention, for connection to the first plug 4. The second portion 7 of the holder 1 having two major components, a slide receptacle 20 and a resilient lock 21. The slide receptacle 20 is formed by two guide webs 22, which each have a web face 23 facing inwards. When viewed from the exterior, the guide webs 22 form a fork-shaped outer face 24 of the second portion 7 of the holder 1, from which face the lock 21 projects outwards slightly. The lock 21 projects almost up to a shaft-side portion 29 of the outer face 24. The lock 21 has a beveled edge 25, which at a maximum distance or elevation, rises from the outer face 24 to an end and a rear 26 of the second plug 5. When viewed from the side, the lock 21 has a substantially triangular shape.

The lock 21 virtually forms a ramp or a flag, which can yield laterally or is resiliently pivotable.

The guide webs 22 project in part over a right-angled inner receiving face 27 of the slide receptacle 20 on the two longitudinal sides thereof. When the first and second portions 6, 7 of the holder 1 are fitted together, the inner receiving face 27 of the slide receptacle 20 forms a guide way for the slide 10 where an upper side 12 of slide subsequently rests against the inner receiving face 27 of the slide receptacle 20, in order to slide. Two longitudinally extending inner sides 28 of the guide webs 22 form a lateral guide for the slide receptacle 20.

Figure 3:
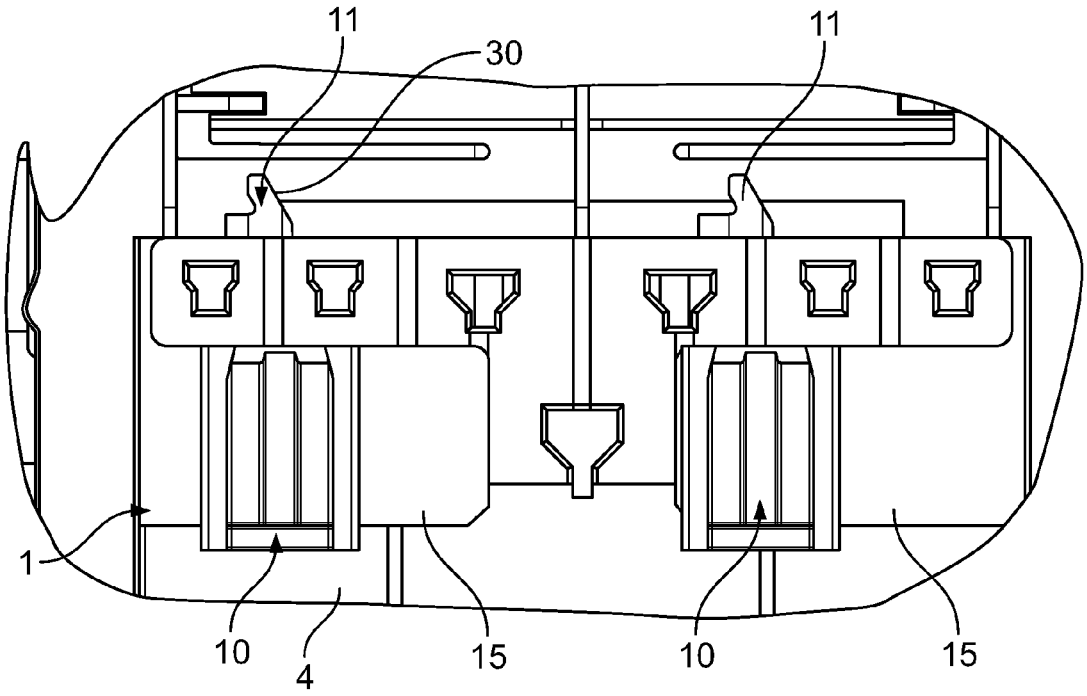
FIG. 3 is a plan view of the first plug including the holder of FIG. 1.
Figure 4:
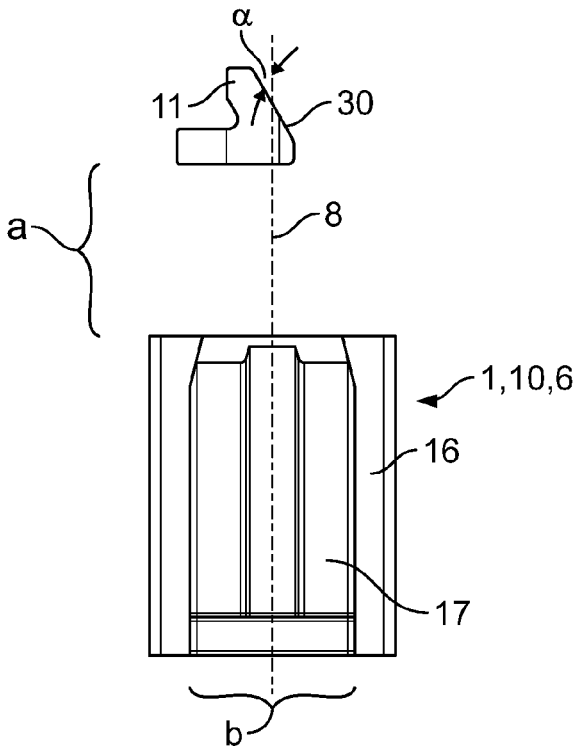
FIG. 4 is a top view of the holder of the first plug from FIG. 1 and FIG. 3.

With reference to FIGS. 3 and 4, the securing member 11 of the first plug 4 is arranged so as to be laterally offset relative to a longitudinal axis 8 of the slide 10. The securing member 11 has a substantially triangular base, a bevel 30 extending transversely to the longitudinal axis 8. An enclosed angle $\alpha$ is at an angle of, for example, 45 degrees. The smallest distance a between the slide 10 and the securing member 11 is approximately a width b of the tongue 17 of the slide 10.

Figure 5:
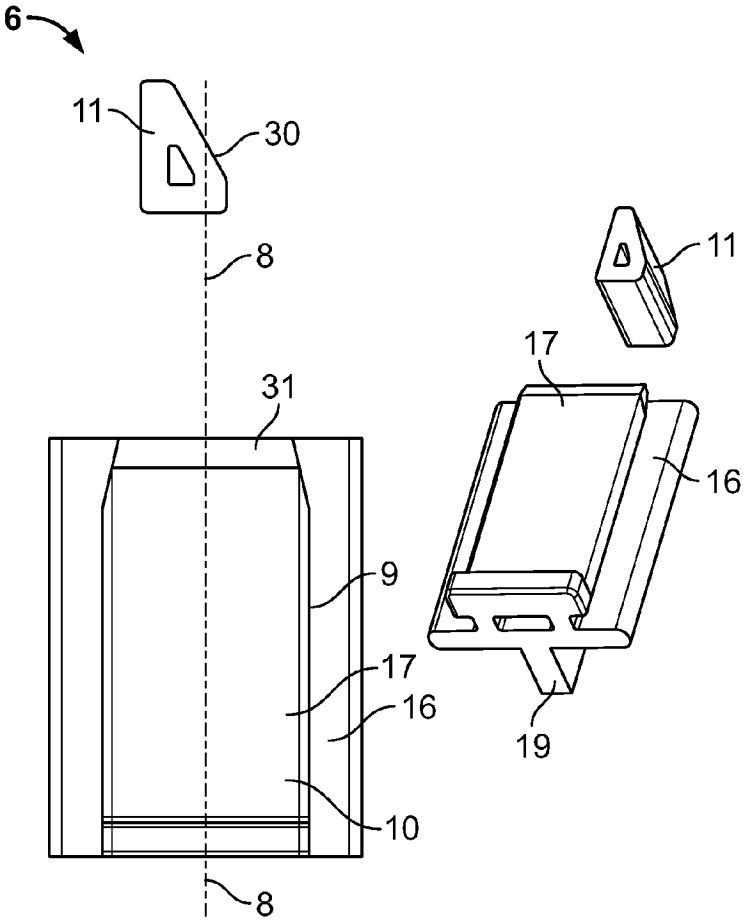
FIG. 5 is a top view (left) and a perspective view (right) of another embodiment of the first portion of the holder of the first plug according to the invention.

FIG. 5 shows the first portion 6 of the holder 1 of the first plug 4. However, a longitudinal member 19 is shown, which can be provided according to another embodiment instead of the base 15 or in addition thereto, for connecting the holder 1 to the housing 14 (not shown in FIG. 5) of the first plug 4. The longitudinal member 19 extends in the direction of the longitudinal axis 8 and forms a T-shape with the foot 16.

Figure 6:
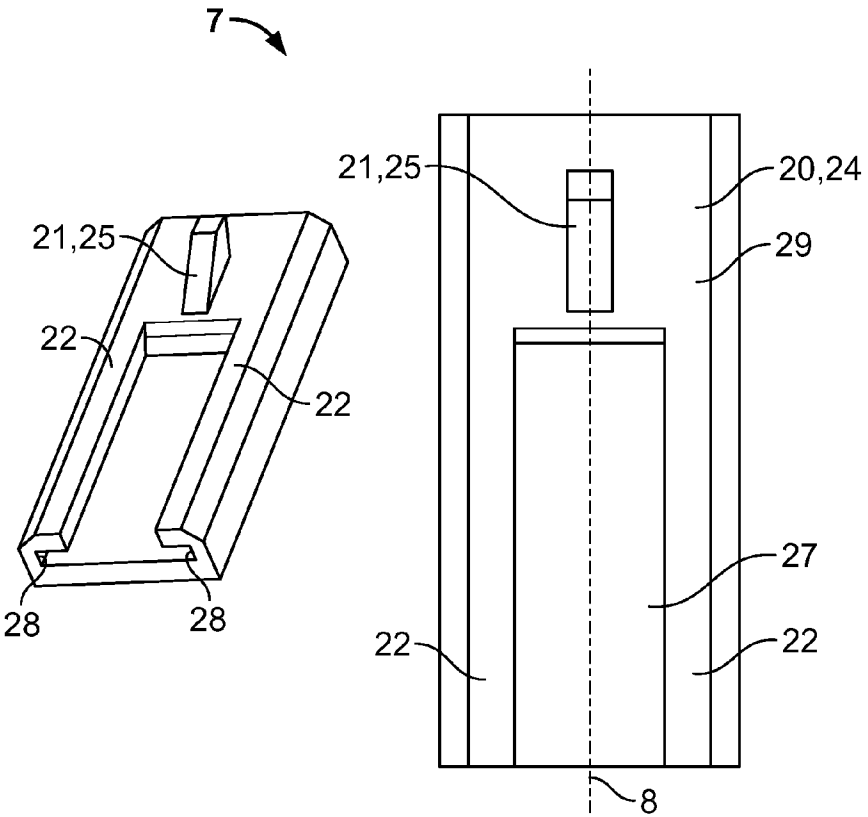
FIG. 6 is a perspective view (left) and a bottom view (right) of the second portion of the holder of the second plug according to FIG. 2.

The second portion 7 of the holder 1 of the second plug 5 according to FIG. 2, which is shown in FIG. 6 from below and, on the left, in a perspective view, is pushed onto the slide 10. The slide 10 forms a guide rail for the slide receptacle 20 which virtually represents the guide way. The lock 21 extends in an aligned manner in the direction of the longitudinal axis 8 of the second portion 7 of the holder 1, which axis corresponds to the longitudinal axis 8 of the slide 10. The outer face 24 is substantially fork-shaped as in FIG. 2, the shaft-side portion 29 being formed so as to be right-angled, without narrowing as in FIG. 2.

Figure 8:
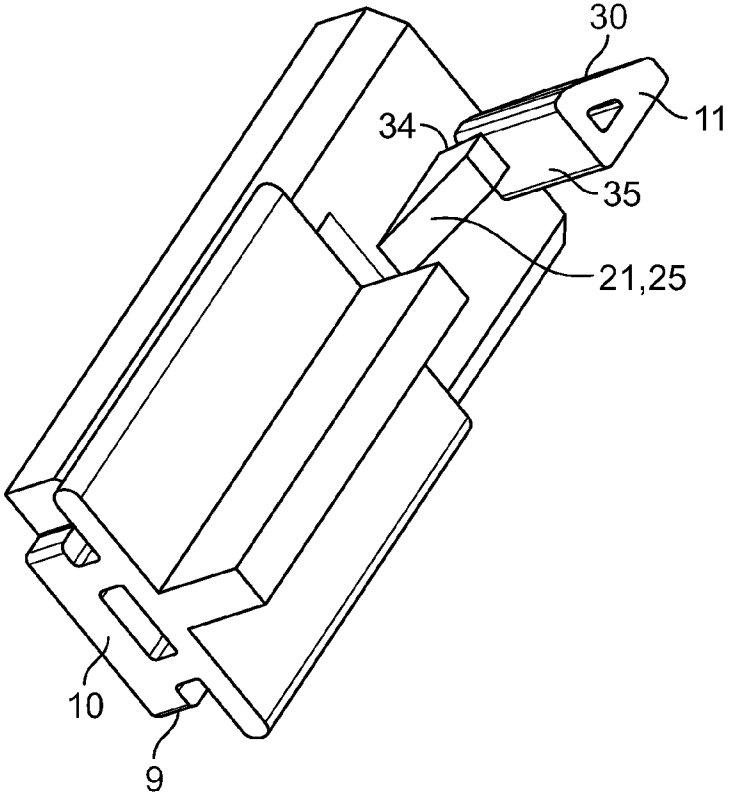
FIG. 8 is a perspective view from below of the holder of the first portion from FIG. 5 without the first plug after a securing member of the second plug engages a lock of the first plug.
Figure 7:
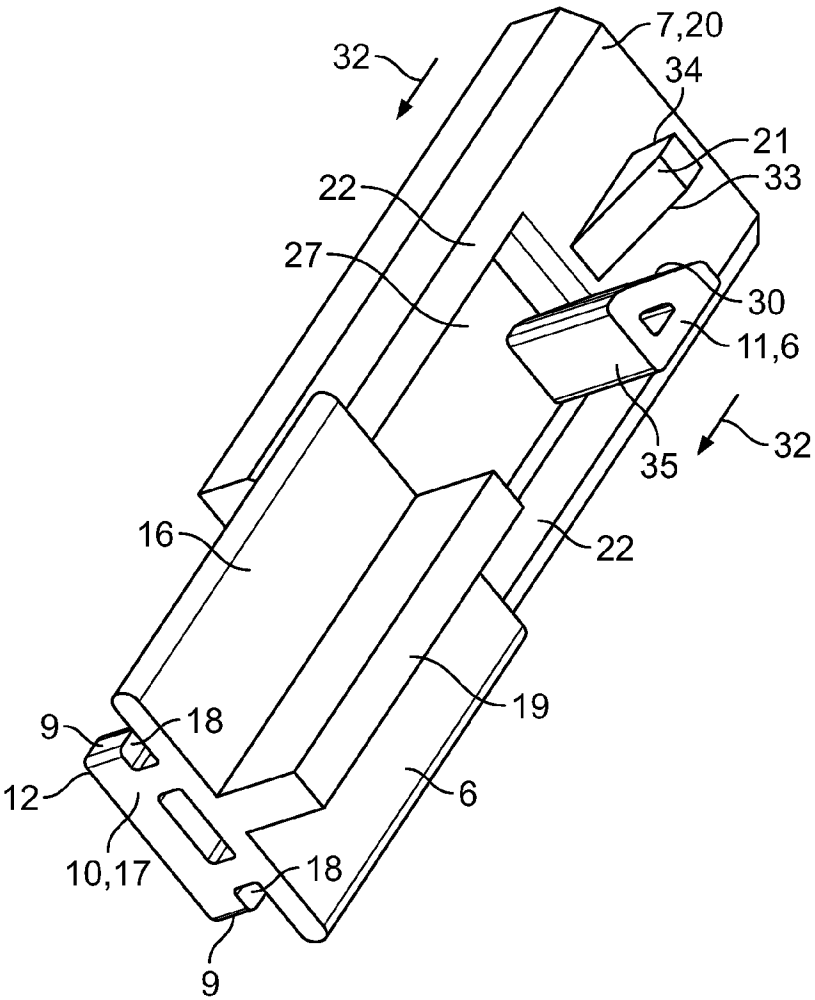
FIG. 7 is a perspective view from below of the holder of the first portion from FIG. 5 without the first plug before a securing member of the second plug engages a lock of the first plug.

FIG. 7 shows a configuration after the second plug 5 or the second portion 7 of the holder 1 is introduced onto the first portion 6 of the holder 1. The second portion 7 or the slide receptacle 20 is thus displaced in a direction of arrow 32 shown, the first portion 6 of the holder 1 being stationary. The connection between the second portion 7 of the holder 1 and the first portion 6 of the holder 1, on completion of the connection, is shown in a perspective view from below in FIG. 8. The securing member 11 can be made of solid material, as in FIG. 1, or can be formed so as to be hollow, as shown in FIG. 8. Plastic materials are suitable as the material in both cases. In one embodiment, the securing member 11, like the slide 10, is simply integrally molded on the first plug 4.

When the second plug 5 is introduced, through the slide receptacle 20 and onto the slide 10, the slide 10 is initially placed slightly obliquely thereon from above and is pushed in easily by the tongue bevel 31. As shown in FIG. 7, the inner receiving face 27 thus rests on the upper side 12 of the slide 10, the guide webs 22 engaging on both sides at the same time in the inner groove 18 and resting, for example, with the inner sides 28 on the slide faces 9 and thus guiding the slide receptacle 20.

The slide receptacle 20 can initially be slid onto the slide 10 until the side or the triangular side face 33 of the lock 21 strikes the bevel 30 of the securing member 11. Further pushing using a low degree of force then leads to the lock 21 being resiliently distorted, or pivoted away or out on the securing member 11. After sweeping or sliding the securing member 11 along the bevel 30, when the slide receptacle 20 or the second plug 5 has completely docked with the first plug 4, the lock 21 engages from behind with the securing member 11. The second plug 5 thus reaches a rest position. In this way, a narrow end face 34 of the lock 21 rests on an end face 35 of the securing member 11 which faces the slide 10. The lock 21 or the flag is locked. Accidentally removing the second plug 5 from the first plug 4 is thus not possible. The lock 21 may thus be referred to as a locking flag and the slide 10 can be referred to as a locking slide.

The housing 14 of the first plug 4, the slide 10 and the securing member 11 are advantageously formed in one piece, for which purpose plastic materials are preferably used. This results in a simple and cost-effective way of producing the holder 1 on the first and second plugs 4, 5.

This new type of holder allows the second plug 5 to be securely fastened to the first plug 4, the second plug 5 being reliably secured, in particular against being removed accidentally. It is advantageous that the first portion 6 of holder 1, provided on the first plug 4, include elements formed so as to be substantially rigid so additional movable constructional elements, such as locking latches or the like, can be dispensed with.

In another embodiment of the invention, it is provided that the first plug 4 is configured in such a way that it is formed in one piece with the slide 10 and the securing member 11. This is a simple and cost-effective way of producing the holder 1 with the first plug 4.

While the embodiments of the present invention have been illustrated in detail, it should be apparent that modifications and adaptations to those embodiments may occur. The scope of the invention is therefore limited only by the following claims.

The invention claimed is:

1. A holder for first and second electrical plugs, comprising:

a slide formed on the first plug, having a tongue, a foot connecting with the tongue by a connecting member, and an inner groove along the foot and the tongue separating the foot and the tongue;

a slide receptacle formed on the second plug and configured to connect with the slide upon connection;

a securing member formed on the first plug at a distance away from the slide; a resilient lock formed on the second plug at a distance away from the slide receptacle, the resilient lock being engageable with the securing member; and a releasable connection formed between the first plug and the second plug when the slide receptacle connects with the slide and the securing member engages the resilient lock.

2. The holder according claim 1, wherein the securing member is arranged laterally offset relative to a longitudinal axis of the slide.

3. The holder according to claim 2, wherein the securing member is hollow.

4. The holder according claim 1, further comprising a bevel formed on the securing member.

5. The holder according to claim 4, wherein the securing member includes a substantially triangular base and the bevel extends transversely to a longitudinal axis by approximately 45 degrees.

6. The holder according to claim 4, wherein the lock includes a beveled edge rising towards a rear of the second plug.

7. The holder according claim 4, wherein the first plug is an integral construction with the slide and the securing member.

8. The holder according claim 2, further comprising a bevel formed on the securing member.

9. The holder according to claim 8, wherein the securing member has a substantially triangular base and the bevel extends transversely to the longitudinal axis by approximately 45 degrees.

10. The holder according to claim 2, wherein the securing member is positioned at a distance from the slide.

11. The holder according to claim 10, wherein a smallest distance (a) that the securing member is positioned from the slide is approximately a width (b) of a tongue of the slide.

12. The holder according to claim 1, wherein the lock has a beveled edge rising towards a rear of the second plug.

13. The holder according claim 1, wherein the first plug is an integral construction with the slide and the securing member.

14. A holder for first and second electrical plugs, comprising:

a slide formed on the first plug, having a tongue, a foot, and an inner groove arranged with the slide, the inner groove recessed between the foot and the tongue;

a slide receptacle formed on the second plug and configured to connect with the slide upon connection;

a securing member formed on the first plug at a distance away from the slide;

a resilient lock formed on the second plug at a distance away from the slide receptacle, the resilient lock being engageable with the securing member;

a releasable connection formed between the first plug and the second plug when the slide receptacle connects with the slide and the securing member engages the resilient lock, and two guide webs arranged with the slide receptacle, the guide webs configured to receive the inner groove.

15. The holder according to claim 14, wherein the lock includes a beveled edge rising towards a rear of the second plug.

16. The holder according claim 14, wherein the first plug is an integral construction with the slide and the securing member.

17. The holder according claim 14, wherein the securing member is arranged laterally offset relative to a longitudinal axis of the slide.

18. The holder according to claim 17, wherein the securing member is hollow.

19. The holder according claim 17, further comprising a bevel formed on the securing member.

20. The holder according to claim 19, wherein the securing member has a substantially triangular base and the bevel extends transversely to the longitudinal axis by approximately 45 degrees.

21. The holder according to claim 17, wherein the securing member is positioned at a distance from the slide.

22. The holder according to claim 21, wherein a smallest distance (a) that the securing member is positioned from the slide is approximately a width (b) of the tongue.

* * * * *

UNITED STATES PATENT AND TRADEMARK OFFICE

CERTIFICATE OF CORRECTION

PATENT NO. : 8,602,808 B2
APPLICATION NO. : 12/637456
DATED : December 10, 2013
INVENTOR(S) : Yehya Ashour It is certified that error appears in the above-identified patent and that said Letters Patent is hereby corrected as shown below:

Title page, (63) the date should be --June 9, 2008--.

In the Specification

In column 1, line 7, after the word "filed" the date should be --June 9, 2008--.

Signed and Sealed this
Seventh Day of October, 2014

Michelle K. Lee

Michelle K. Lee
*Deputy Director of the United States Patent and Trademark Office*